United States Patent [19]

Givens

[11] 4,376,032

[45] Mar. 8, 1983

[54] COAL LIQUEFACTION DESULFURIZATION PROCESS

[75] Inventor: Edwin N. Givens, Bethlehem, Pa.

[73] Assignee: International Coal Refining Company, Allentown, Pa.

[21] Appl. No.: 268,449

[22] Filed: May 29, 1981

[51] Int. Cl.[3] ..... C10G 1/00; C10G 29/00; C10G 29/04

[52] U.S. Cl. ..... 208/8 LE; 208/244; 208/247; 208/249

[58] Field of Search ..... 208/8 LE, 244, 247, 208/249

[56] References Cited

U.S. PATENT DOCUMENTS

| | | | |
|---|---|---|---|
| 738,656 | 9/1903 | Burwell et al. | 208/244 |
| 1,587,491 | 2/1923 | Cross | 208/244 |
| 1,882,146 | 10/1932 | Holmes | 208/244 |
| 2,221,860 | 11/1940 | Dreyfus | 208/39 |
| 2,618,586 | 11/1952 | Hendel | 208/244 |
| 2,697,064 | 12/1954 | Brown | 196/28 |
| 2,950,231 | 8/1960 | Batcheher et al. | 208/249 |
| 2,951,034 | 8/1960 | Stuart | 208/244 |
| 3,063,936 | 11/1962 | Pearce et al. | 280/211 |
| 3,284,345 | 11/1966 | Ishiko et al. | 280/244 |
| 3,477,941 | 11/1969 | Nelson | 208/8 LE |
| 3,733,260 | 5/1973 | Davies et al. | 208/216 R |
| 3,769,197 | 8/1971 | Leas et al. | 208/8 |
| 3,807,090 | 5/1974 | Moss | 208/208 M |
| 3,932,266 | 1/1976 | Szi et al. | 208/8 LE |
| 3,996,130 | 12/1976 | Nametkin | 208/244 |
| 4,077,866 | 3/1978 | Owen et al. | 208/9 |
| 4,190,518 | 2/1980 | Giannetti et al. | 208/8 |

*Primary Examiner*—Delbert E. Gantz
*Assistant Examiner*—Helane E. Maull
*Attorney, Agent, or Firm*—Mark F. Wachter

[57] ABSTRACT

In a solvent refined coal liquefaction process, more effective desulfurization of the high boiling point components is effected by first stripping the solvent-coal reacted slurry of lower boiling point components, particularly including hydrogen sulfide and low molecular weight sulfur compounds, and then reacting the slurry with a solid sulfur getter material, such as iron. The sulfur getter compound, with reacted sulfur included, is then removed with other solids in the slurry.

11 Claims, 1 Drawing Figure

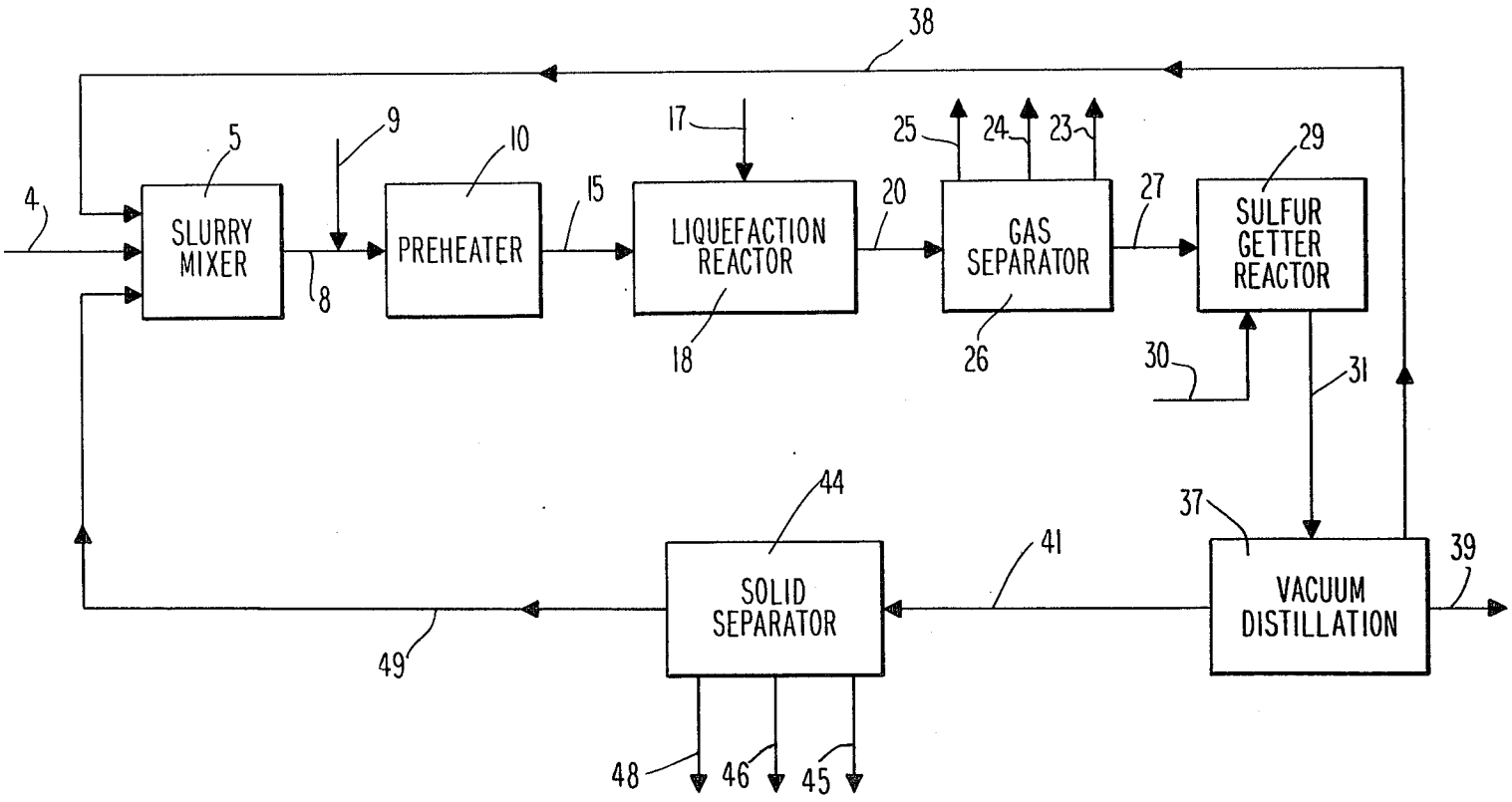
SLURRY MIXER
PREHEATER
LIQUEFACTION REACTOR
GAS SEPARATOR
SULFUR GETTER REACTOR
VACUUM DISTILLATION
SOLID SEPARATOR
4
5
8
9
10
15
17
18
20
23
24
25
26
27
29
30
31
37
38
39
41
44
45
46
48
49

COAL LIQUEFACTION DESULFURIZATION PROCESS

The Government of the United States of America has rights in this invention pursuant to Contract No. DE-AC05-780R03054 (as modified) awarded by the U.S. Department of Energy.

BACKGROUND OF THE INVENTION

This invention pertains to desulfurization of solvent refined coal liquefaction products.

As background to the present invention, U.S. Pat. No. 4,077,866—Owen et al appears to be of primary interest. It proposes a solvent coal refining process in which the coal slurry is desulfurized by contact with a solid sulfur scavenger, such as iron (but which may include any of numerous other materials, some of which are also disclosed herein). The inclusion of the sulfur scavenger in the solvent-coal slurry, in accordance with the process of the Owen et al patent, differs from the present invention in that Owen et al would require sufficient scavenger to react with substantially all of the sulfur present. This includes volatile low molecular weight sulfur compounds and hydrogen sulfide. Indeed, with regard to one example, the Owen et al patent states that (following desulfurization) no gaseous hydrogen sulfide was evolved (Col. 9, lines 55–56).

Other patents considered as background to the present invention include U.S. Pat. Nos. 3,284,345—Ishiko et al; 2,697,064—Brown; 738,656—Burwell et al; 1,587,491—Cross; 3,063,936—Pearce et al; 3,769,197—Leas et al; and 4,190,518—Giannetti.

Ishiko et al teach desulfurization of crude oil or heavy oil by contact with a particularly reactive form of reduced iron powder. A process of this general nature, as related to petroleum fractions, is also referred to in the background portion of the Brown patent.

Other sulfur-reactive reagents are used for desulfurizing vapor phase petroleum products according to the processes disclosed in the Burwell et al and Cross patents.

A more complex desulfurization process for hydrocarbon oils, such as petroleum fractions, but including some of the same sulfur reactants included in the disclosure of the present invention, is seen in U.S. Pat. No. 3,063,936—Pearce et al.

Finally, U.S. Pat. Nos. 3,769,197—Leas et al and 4,190,518—Giannetti et al both pertain to solvent refined coal desulfurization processes, wherein sulfur is extracted by reaction in the vapor phase. Coincidentally, the solvent coal slurry in the Giannetti et al process is hydrogenated (and any sulfur compounds present probably converted to some other form) in the presence of a hydrogenation catalyst, which is chosen from a wide range of materials including many compounds similar to those referred to herein as sulfur getters.

Notwithstanding these prior processes, there remains a continuing need for more efficient means for desulfurizing solvent refined coal products, and particularly the non-volatile portions thereof. Because, non-volatile sulfur compounds in solvent refined coal products tend to be high molecular weight multi-cyclic anthracene and phenanthrene-type compounds, such compounds are somewhat more difficult to remove than other sulfur compounds. In high boiling point solvent refined coal fractions, these heavy sulfur compounds may comprise on the order of 1% by weight of the product.

However, reduction of sulfur content in these fractions, by as little as a tenth of a percent, may be significant in some circumstances.

It is therefore the general object of the present invention to provide a solvent coal refining desulfurization process improved with respect to simplicity and efficiency of sulfur capture as compared to prior known processes.

BRIEF DESCRIPTION OF THE INVENTION

In brief, the present invention comprises a coal liquefaction desulfurization process wherein coal is reacted with hydrogen in a hydrogen donor solvent at elevated temperature and pressure, generally on the order of 500° +F. and 300+ psig, to form a reacted solvent-coal mixture. In accordance with the present invention, this mixture is first stripped of its lower boiling point components (devolatilized), such as by flash vaporization of the lower boiling point components at 300°–850° F. and elevated pressure. The stripped gases may be desulfurized by conventional processes and separated into hydrogen or low molecular weight hydrocarbon components, which may be recycled or used as plant fuel and carbon oxides which may also be further processed. The remaining reacted solvent-coal slurry is then desulfurized, in accordance with the present invention, by contact with a sulfur-reactive "getter" material.

The getter may be combined with the reacted solvent-coal mixture in the form of a getter slurry, utilizing the same or a compatible hydrogen donor solvent. The getter, a particulate solid to begin with, reacts to form a solid getter-sulfur compound, removable with other insoluble components of the slurry, in a conventional solids removal step.

In general, a getter reaction time of up to 60 minutes may be required and the proportion of getter used is on the order of 1–10% by weight, based on the weight of reacted coal in the devolatilized reacted coal-solvent slurry. Agitation or transport of mixture through tubular reactors may be utilized to effect more efficient reaction with the getter material.

The process parameters for reaction time, proportion of getter, and process conditions will of course vary over a wide range depending on the relative reactivity of the getter, the degree of desulfurization required, and the characteristics of the coal feed. Obviously then, reaction time and temperature-pressure conditions will be selected to effect the desired degree of desulfurization in any specific situation. In all cases, however, it is expected that the sulfur getter reaction will function most effectively at elevated temperature. It is therefore highly preferred that the present invention be incorporated in a coal liquefaction process in which the getter is added to a liquid mixture already at elevated temperature, preferably above 300° F.

Materials which may be used as sulfur getters, in accordance with the present invention, include iron, and iron compounds such as iron oxide (both ferrous and ferric forms) and ferrous carbonate, including mineral forms thereof such as siderite. Other getters include manganese, nickel, calcium, zinc, lead, and compounds including these elements, particularly including oxides and carbonates thereof, and, in the case of calcium, limestone (typically calcium carbonate or a mixture of calcium and magnesium oxide and carbonate). Of these possible getter materials, metallic iron is presently preferred.

BRIEF DESCRIPTION OF FIGURE

The accompanying FIGURE comprises a schematic illustration of a coal liquefaction desulfurization process in accordance with the present invention.

DETAILED DESCRIPTION OF THE INVENTION

For a better understanding of the present invention, reference may be made to the following detailed description thereof, taken in conjunction with the accompanying FIGURE, and the appended claims.

Referring more specifically to the FIGURE, there is shown a process wherein coal feed 4, in finely divided or comminuted form, is combined with a hydrogen donor solvent in slurry mixer 5. Such a solvent may comprise, for example, tetrahydronapthalene, partially hydrogenated phenanthrenes, creosote oil, hydrogenated creosote oils, or process recycle streams having similar solvent characteristics (or combinations of the foregoing). In the embodiment of the invention shown, a recycle oil stream 38, at elevated temperature, provides process solvent and heat for the coal-solvent slurry. Temperature in the mixer may be from ambient to 450° F. A separated solids recycle stream 49 is also introduced into slurry mixer 5.

Slurry from mixer 5, is supplemented by a hydrogen-rich gas enrichment stream 9 to form a liquefaction slurry feed stream 8 which is heated by preheater 10. The heated slurry feed 15 is then passed to liquefaction reactor 18, in which additional fresh hydrogen-rich gas 17 is introduced. In reactor 18, elevated temperature and pressure conditions, on the order of 300–5000 psig and 500°–900° F., are maintained. Under these conditions, solid bridges in the coal matrix are thermally broken and resultant carbonaceous products are dissolved in the solvent. The reacted solvent-coal slurry 20 from liquefaction reactor 18 is passed into a conventional separator 26, such as a multi-stage flash evaporator operated at temperature and pressure conditions selected generally to remove volatile components having an ambient pressure boiling point below 450° F. Preferably gas separator 26 operates at the pressure of reactor 18 and from 300° F. up to within 25° F. of the outlet temperature from reactor 18.

Individual streams which may be separated, for example, are a hydrogen-rich stream 23, a hydrogen sulfide-rich stream 24, and a stream 25 consisting predominately of carbon oxides and low molecular weight hydrocarbons. These streams may also be treated for sulfur or sulfur compound removal by conventional gas treatment technology.

The remaining devolatilized reacted solvent-coal stream 27 proceeds to a sulfur getter reactor zone 29. There the mixture, at a temperature above 300° F., is contacted for up to 60 minutes with a "sulfur getter". A "sulfur getter" is a sulfur-reactive solid material, such as particulate metallic iron, preferably in slurry with a solvent, wherein the solvent may consist of additional hydrogen donor solvent, the same as or compatible with that used in slurry mixer 5. Getter-slurry stream 30, reacted with devolatiled reacted solvent-coal slurry stream 27, forms an intermediate product stream 31.

Effective and practical sulfur capture in reactor 29 requires maintenance of an elevated temperature there. Preferably, this results inherently from the heat input of devolatilized, reacted solvent-coal stream 27, the normal process temperature of which is well above 300° F. The temperature and time of reaction in sulfur getter reactor 29, preferably above 300° F. and up to 60 minutes, is maintained so as to effect the desired degree of desulfurization therein. In sulfur getter reactor 29, the sulfur getter forms a getter-sulfur compound which is also solid. Intermediate product stream 31 is then forwarded to a vacuum distillation stage 37, wherein a recycle oil stream 38 (having an ambient pressure boiling range of 450°–900° F.) is removed and recycled as process solvent to slurry mixer 5. A further gaseous component stream 39 (a light distillate fraction boiling up to 450° F.) is evolved and separated and the remaining higher boiling point components are forwarded to a multi-stage solid separator system 44, which may consist of critical solvent separation or fractional phase separation systems, centrifuges or filters, wherein one or more separate solid carbonaceous product streams 46 and 48 are removed. One suitable solids separation system is a critical solvent de-ashing process as disclosed in U.S. Pat. No. 4,119,523. In addition, a mineral matter and unconverted maceral-rich residue stream 45 is also separated.

A portion 49 of ash- and mineral residue-free carbonaceous product in separator 44 may be recycled to the slurry mix zone 5.

Alternatively, solid separator system 44 may precede the vacuum distillation stage 37 in order to allow the use of a filter, centrifuge or other solids separations technique to remove the mineral solid residue before subjecting the de-ashed filtrate to the vacuum distillation stage 37.

In general, the process invention disclosed here relates to an improved liquefaction process by which coal can be effectively converted to a low ash and low sulfur carbonaceous material, referred to generically as "solvent refined coal". It can be used as a fuel in an environmentally acceptable manner without costly gas scrubbing equipment.

Conventionally, coal is slurried with a hydrogen donor solvent, sometimes referred to as a pasting oil, passed through a preheater, and then through one or more dissolvers, in the presence of hydrogen-rich gases, at elevated temperature and pressure.

In accordance with the present invention, this reactor effluent is devolatized to remove, among other things, low molecular weight compounds and hydrogen sulfide gas. To the remaining slurry reactor effluent is added a sulfur getter material, preferably metallic iron. Solids, including the reacted getter, plus mineral ash and unconverted coal macerals are then separated from the condensed reactor effluent.

Sulfur getters have long been known to entrap sulfur from sulfur bearing hydrocarbonaceous liquids including petroleum liquids and coal liquids. However, sulfur getters tend to react preferentially with more reactive sulfur compounds particularly including hydrogen sulfide and low molecular weight organic sulfur compounds.

In accordance with the present invention, the low molecular weight sulfur organic compounds and hydrogen sulfide, which would otherwise react preferentially with the getter material, are removed by a gas stripping or devolatilization stage, prior to reaction with the getter material. Sulfur compounds remaining in the devolatilized mixtures tend to be more complex and higher molecular weight organic-sulfur compounds. And it is these compounds which remain available for reaction with the getter material in the resultant reacted solvent-coal mixture.

A sulfur "getter" functions by combining with sulfur to form a tightly knit chemically bound sulfur compound, subsequently removable in the process of the present invention with other solid materials such as ash. Among known getter materials, iron is perhaps best known. In metallic form or in the form of an oxide or carbonate, it readily combines with sulfur compounds to form iron sulfides.

Other metals also known to be sulfur getters are manganese, nickel, calcium, zinc, and lead. These metals also function either in metallic form or as a metal oxide or carbonate. In some cases, such as zinc chloride, metal halides, particularly chlorides, are also effective. In the case of iron, either the ferrous or ferric compounds will readily form iron sulfide. Minerals containing sulfur-reactive metal, such as iron, also function as getters. Examples of such metal compounds include the mineral siderite, which contains $FeCO_3$ and limestone, comprised largely of calcium carbonate.

In the process of the present invention, the getter materials can be used alone or as combinations and are preferably used as fine powders having particulate sizes less than 14 mesh (Tyler Classification System) in size. These powders may be mixed with process solvents or other suitable vehicles in which to suspend the powders for introduction into the process stream.

In some cases, the sulfur gettering action may be activated or enhanced by reaction of the getter with hydrogen. For that purpose, a very slow hydrogen flow may be passed through the sulfur getter holding tank to improve the efficiency of the sulfur capture by the getter.

In a typical solvent-coal liquefaction process, solid bridges holding the framework of coal intact are thermally broken and free radical sites thus generated are terminated by a hydrogen donor solvent. In the dissolution process, water and $H_2S$ are formed in abundance. To some degree, this results from cleavage of heteroatoms containing sulfur in the coal.

Liquefaction occurs rapidly with many coals, often in a matter of minutes. However, longer residence times are necessary to significantly reduce the sulfur content typically contributed by heteroatoms in the higher boiling point components of the solvent refined coal. This longer residence time, while it may also be dictated by other process parameters, is generally undesirable not only because it would normally entail a larger reactor, but also because it is accompanied by higher hydrogen consumption rates, higher residual yields, lower hydrocarbon gas concentrations in the product.

Coal, suitable for conventional processes of the type adopted for use of the present invention, is generally that of a rank lower than anthracite, such as bituminous, sub-bituminous, or lignite, or mixtures thereof. The coal may be used directly from the mine or may be precleaned to remove a portion of the entrained mineral matter. In any event, solid feed material is generally ground to a size typically less than 8 mesh (Tyler Screen Classification), or more preferentially less than 20 mesh, and dried to remove substantial moisture to a level for bituminous or sub-bituminous coals of less than 4 weight %. The concentration of coal in the slurry may vary from 20 to 55% by weight. In the slurry mix tank, the mixture must be maintained at elevated temperatures to keep the viscosity of the solvent low enough to pump it and sufficiently high so that moisture entrained in the feed coal will be removed. For reaction, the slurry is pumped up to pressures on the order of 300–5000 psig and the slurry is mixed with a hydrogen-rich gaseous stream at a ratio of from 10,000–40,000 standard cubic foot per ton of feed coal. The three phase gas slurry stream is then introduced into a preheater system, which may consist of a tubular reactor, and the three phase mixture, with its temperature increased to the order of 600°–850° F., preferably to a maximum of 800° F., is introduced to one or more dissolver vessels, typically tubular reactors operated in an adiabatic mode.

In the preheater section, the viscosity of the slurry changes as the slurry flows through the tubes and coal is dissolved, forming initially a gel-like material which shortly thereafter diminishes sharply in viscosity to a relatively freely flowing fluid. Upon entry into the dissolver, other changes occur. These changes include further dissolution of the coal and liquid, hydrogen transfer from the solvent to the coal, rehydrogenation of recycled solvent, removal of heteroatoms (S, N, oxygen) from the coal and recycled feed, reduction of certain components in the coal ash, such as $FeS_2$ to FeS, and hydrocracking of heavy coal liquids. To some degree, the mineral matter in the coal may catalyze the above reactions.

Upon exiting the dissolvers, the solvent-coal mixture is generally separated through several stages in which the pressure is dropped in a stepwise manner giving rise to overhead streams successively enriched in higher boiling point components. The lower boiling point effluents are treated in a gas handling system wherein ultimately the vapors are cooled and let down in pressure to recover the light gases, water, and organic-rich condensates. The separation, collection, and gas purification steps may be accomplished in a gas treatment area where the overhead from each separator is combined. The variety of methods available for gas separation and handling are well known to those skilled in the art. In any event, it is in these gas separation stages of the separator, handling effluent from the dissolvers, that low molecular weight sulfur compounds and hydrogen sulfide are generally removed, prior to gettering in accordance with the present invention.

Depending on the process, the solvent-coal mixture in the dissolvers may be remixed with fresh hydrogen and injected into additional dissolver vessels for further reaction. Effluent from this second or downstream dissolver is also flashed for removal of lower boiling point components.

In general, the light gases removed include hydrogen, hydrogen sulfide, carbon monoxide, carbon dioxide, nitrogen, water, and $C_1$–$C_4$ hydrocarbons. These gases may be scrubbed to remove acidic or alkaline components in the hydrogen stream and the hydrogen and lower hydrocarbons may be recycled in various stages in the process or may be burned for fuel.

In accordance with the present invention, the remaining effluent, consisting of liquid/solid slurry, is then contacted with the sulfur getter, preferably contained in a slurry with additional process solvent.

The combination of separator underflow plus sulfur scavenger (getter) may in some cases require a holding time to allow adequate reaction to occur. In this reaction-holding process, materials may be held in a reaction vessel for any desired length of time to achieve a desired degree of desulfurization. The effluent from this holding vessel is then passed to an ash separation system from which residue is rejected and the contaminant mineral and solids-free solvent refined coal materials are obtained. If desired, part of the effluent from the separator may be passed directly to the solids separation unit without having to pass through a stage where a sulfur getter is employed.

In one embodiment of this process, the effluent stream from the holding vessel may be fed directly to a vacuum distillation tower prior to solids separation.

As previously indicated, the primary advantages of the present invention are that by the prior removal of low boiling point components, particularly including $H_2S$ and low molecular weight sulfur compounds, the sulfur getter is more effectively utilized to remove sulfur heteroatoms and higher molecular weight sulfur compounds, rather than the low molecular weight sulfur compounds and hydrogen sulfides which would otherwise preferentially react with the getter. An additional advantage of the present process is the ease of removal of the solids sulfur-getter compound in the process. This permits removal of the sulfur by-product in the ash separation step. The additional solids load on the separation step is minimal compared to the gain realized in reducing the sulfur content.

Still another advantage of the present invention is the utilization of the process temperature of the reacted solvent-coal mixture to effect sulfur gettering without the necessity of any additional heating or reheating. In this respect, the temperature of the reacted solvent-coal mixture in conventional practice, usually in the range 300°–700° F., is entirely suitable for the sulfur gettering action in accordance with the present invention.

While this invention has been described with respect to specific embodiments thereof, it is not limited thereto. The appended claims are intended to be construed to encompass not only the forms and embodiments of the invention described but to such other forms and embodiments as may be devised by those skilled in the art, which forms and embodiments are within the true spirit and scope of the present invention.

I claim:

1. An improved process for preparing desulfurized solvent refined coal liquefaction products comprising the steps of:

(a) forming a slurry of comminuted coal and a hydrogen donor solvent, (b) reacting said slurry with hydrogen at elevated temperature and pressure to dissolve a portion of said coal and to form a reacted mixture comprising said slurry, gases and a solution containing volatile and non-volatile solvent refined coal products, (c) separating said gases and said volatile products having an ambient pressure boiling point below about 450° F. from said reacted mixture to form a devolatilized reacted mixture, (d) desulfurizing the remaining portion of said devolatilized reacted mixture by contacting the same with a solvent insoluble sulfur getter, for a time and under conditions sufficient for said getter to react with sulfur in said devolatilized reacted mixture to form getter-sulfur solids and desulfurized solvent refined coal products herein, and (e) separating said getter-sulfur solids and other insoluble solids remaining in said devolatilized reacted mixture from said desulfurized solvent refined coal products.

2. The improved process as recited in claim 1, wherein said volatile products are removed from said reacted mixture at a pressure about the same as that of said coal and solvent reaction and a temperature from 300° F. up to 25° F. below the temperature of said coal and solvent reaction products at the process stage just following said reaction.

3. The improved process, as recited in claim 1, wherein said sulfur getter is added to said devolatilized reacted mixture in the form of a second slurry comprised of said getter and a hydrogen donor solvent compatible with or the same as the solvent of said reacted mixture.

4. The improved process, as recited in claim 1, wherein said sulfur getter added to said devolatilized mixture comprises 0.1–10% by weight of the coal in said reacted mixture.

5. The improved process, as recited in claim 1, wherein said sulfur getter is reacted with said devolatilized reacted mixture for up to 60 minutes.

6. The improved process, as recited in claim 1, wherein remaining solids in said devolatilized reacted mixture are removed, following reaction of said sulfur getter therewith, by filtration thereof.

7. The improved process, as recited in claim 1, wherein remaining solids in said devolatilized reacted mixture are removed, following reaction of said sulfur getter therewith, by a critical solvent de-ashing process.

8. The improved process, as recited in claim 1, wherein said getter is selected from the group consisting of iron, manganese, nickel, calcium, zinc, lead, and oxides and carbonates of these metals.

9. The improved process, as recited in claim 1, wherein said getter is metallic iron.

10. The improved process, as recited in claim 1, wherein said getter-sulfur solids and other insoluble solids are removed from said devolatilized reacted mixture containing said desulfurized solvent refined coal products.

11. The improved process, as recited in claim 1, wherein said devolatilized reacted mixture is at a temperature above about 300° F. when contacted with said insoluble surfur getter.

* * * * *